United States Patent [19]

Hellmann

[11] 4,128,055

[45] Dec. 5, 1978

[54] MANUAL TRASH COMPACTOR

[76] Inventor: James J. Hellmann, 6600 SW. 127th St., Miami, Fla. 33156

[21] Appl. No.: 815,221

[22] Filed: Jul. 13, 1977

[51] Int. Cl.[2] ..... B30B 1/04

[52] U.S. Cl. ..... 100/245; 100/255; 100/265; 100/295; 232/43.2; 248/101

[58] Field of Search ..... 100/255, 295, 229 A, 100/240, 265, 245; 248/101, 24; 232/43.2; 229/14 B; 53/124 B; 241/169.2

[56] References Cited

U.S. PATENT DOCUMENTS

| | | | |
|---|---|---|---|
| 944,823 | 12/1909 | Rohrer | 100/245 |
| 2,970,533 | 2/1961 | Allen | 100/255 X |
| 3,107,711 | 10/1963 | Azmus | 241/169.2 |
| 3,226,015 | 12/1965 | Manfredonia | 248/101 X |
| 3,241,750 | 3/1966 | Brighton | 248/101 X |
| 3,311,331 | 3/1967 | Steimen | 248/24 |
| 3,357,346 | 12/1967 | Crafoord | 100/245 X |
| 3,613,566 | 10/1971 | Shapleigh | 100/255 |
| 3,744,409 | 7/1973 | Bradbury | 100/245 |

FOREIGN PATENT DOCUMENTS

| | | | |
|---|---|---|---|
| 637907 | 1/1964 | Belgium | 229/14 B |

*Primary Examiner*—Billy J. Wilhite
*Attorney, Agent, or Firm*—Leonard W. Suroff

[57] ABSTRACT

A manual trash compactor that comprises a housing adapted to receive therein a bag having upstanding walls terminating in an open top for depositing the trash, and formed having a base with vertically extending panels extending upwardly from the base and terminating in an upper open end such that a rectangular configuration is formed to gain access to the housing. Pressure applying means for compacting the trash within the bag is provided with weighting means associated with the pressure applying means to increase the weight thereof to facilitate the compacting of the trash within the bag. Retaining means for releasably securing the open top of the bag within the housing during operation of the pressure applying means is utilized and comprises a plate operatively associated with each one of the panels to provide retention of the open top of the walls of the bag in fixed relationship to each one of the panels. Mounting means for pivotally securing each one of the plates with respect to one of the panels between an open position and a closed position is provided for permitting the bag to be removed from the housing in the open position and in the closed position compressing the upstanding walls of the bag against the panels. Latching means for releasably retaining each one of the plates in the closed position is provided such that the bag may be filled with trash.

27 Claims, 8 Drawing Figures

FIG. 4
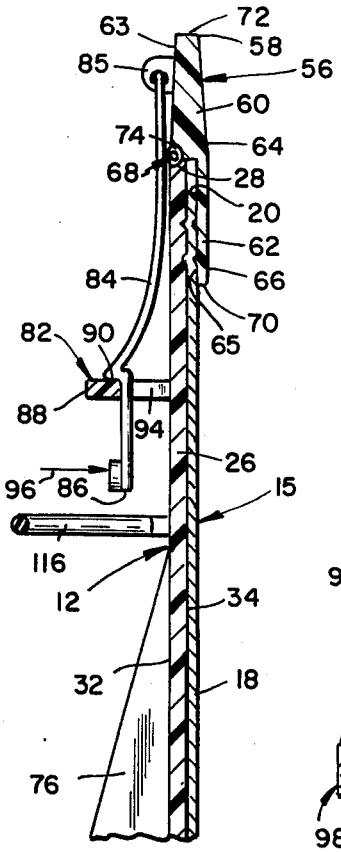
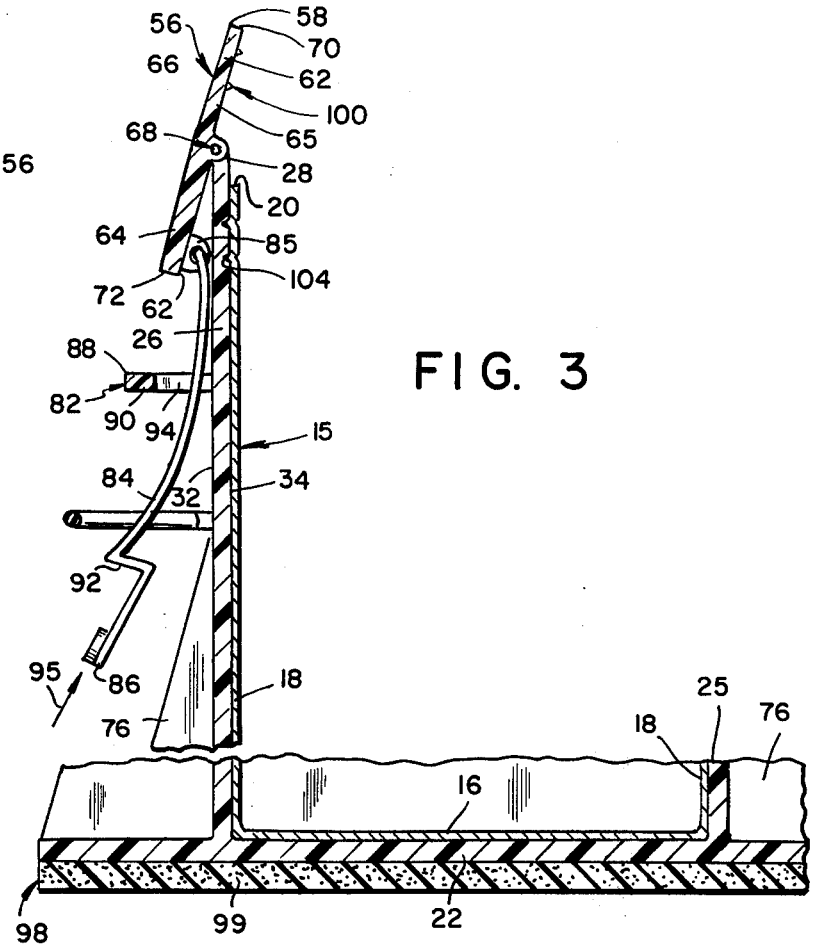
FIG. 3
FIG. 5
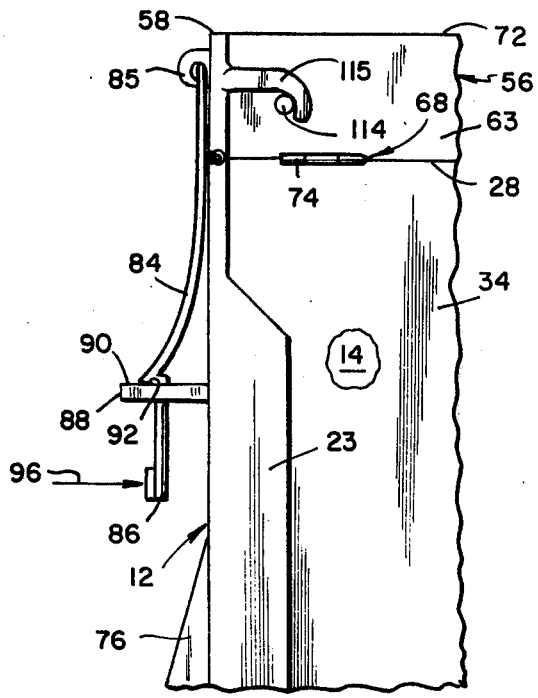
FIG. 6
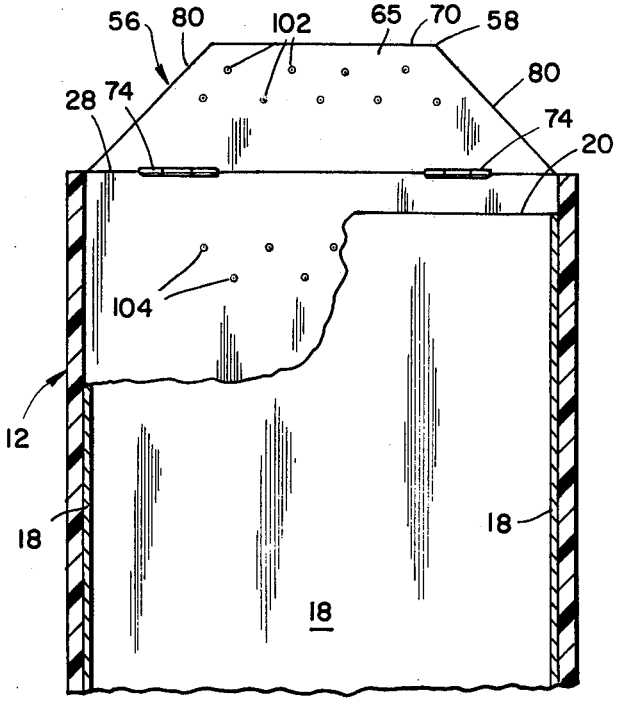

FIG. 7
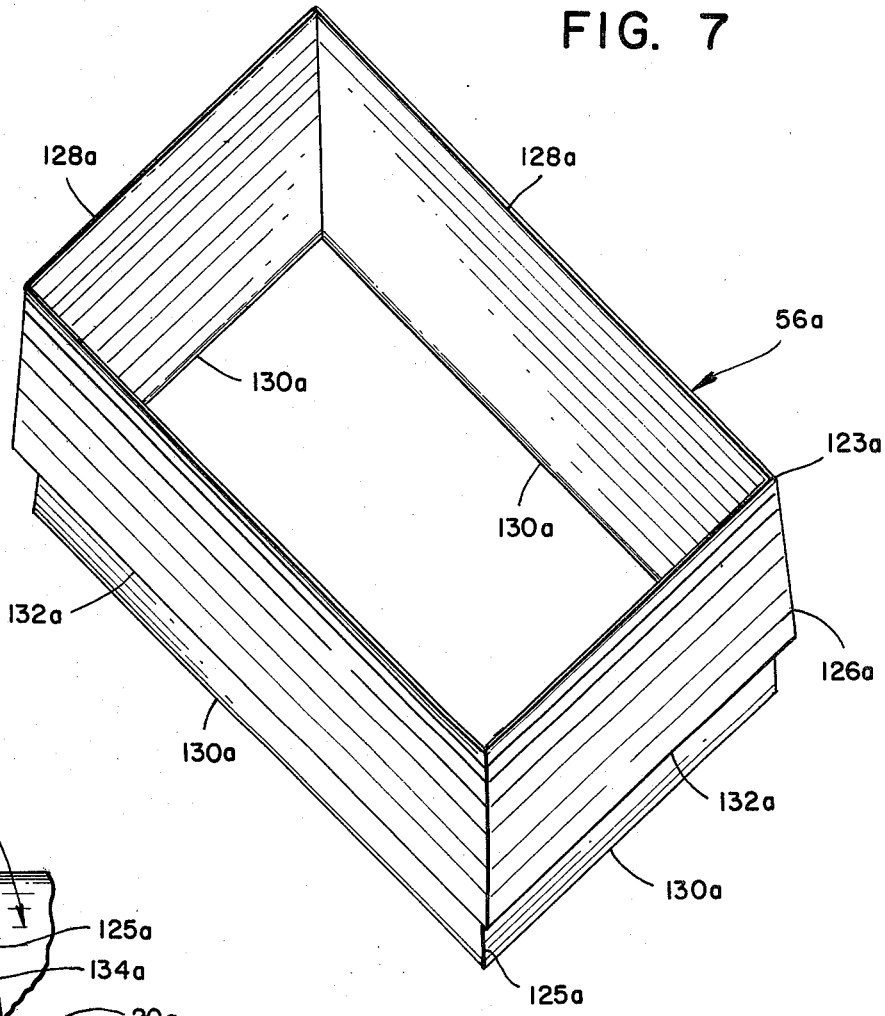
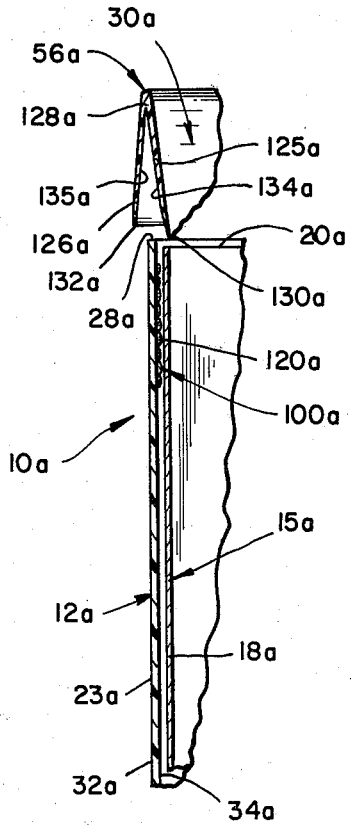
FIG. 8

MANUAL TRASH COMPACTOR

BACKGROUND OF THE INVENTION

The present invention relates to a manual trash compactor that can use a disposable conventional paper bag or even plastic bags. In today's times trash disposal is already a worldwide problem and threatens to become more severe. In the home itself, and in stores and industries, the space occupied by filled bags is voluminous, and this is particularly so in crowded apartment houses and residential areas. Another problem is that of preparing such trash for easy and efficient carting to dumps or recycling centers for disposal. Therefore, an easy to use, convenient, relatively low cost, and foolproof means for solving the problem is greatly needed.

Many people now use bags for trash but cannot compress the trash very much without splitting the bag or tipping it over. These bags may be produced from paper as is the case when purchasing food when shopping.

Accordingly, it is common practice to locate relatively small waste receptacles in kitchens, bedrooms, offices or other places where waste collects at a rapid rate, but these receptacles are preferably small and should be of an attractive character. Small receptacles are conventionally employed, but after the same have been in use for a short time, it becomes necessary for the depositor of the waste to follow the same into the receptacle with his hand to compress the contents thereof in order that more waste may be received thereby. Obviously, this objectionable and even unsanitary practice should be obviated, and it is possible so to do through the employment of a compactor made in accordance with the present invention.

Already on the market for homes is a mechanized trash compactor which, however, must either be permanently wired into the household as a permanent installation, or must be plugged in an electrical outlet. The units are relatively expensive, have many moving parts with potential maintenance requirements, and many families may not be able to afford such devices. It is also to be noted that there is a need for a trash compaction system which on a low cost basis permits and encourages segregation of trash at the household level, in compacted form, such as glass, ferrous materials, aluminum, plastics, cellulosic materials, etc.

With the rapid decrease of available free land for dumps, burial of non-compacted trash in the so-called land-fill method is an inefficient use of the land. Compacted trash will take much less space.

Accordingly, although powered compactors are commercially available, they are both costly as to initial investment and the upkeep as to maintenance and the purchase of bags. Purchasing of the bags can also be an inconvenience since they are not available everywhere.

OBJECTS OF THE INVENTION

An object of the present invention is to provide a compactor to compress trash therein that may be manually operated.

Another object of the present invention is to provide a compactor in which readily available grocery bags may be utilized therein as the container for the trash.

Another object of the present invention is to provide a compactor that is simple to operate for use in homes, offices, hospitals, etc.

Another object of the present invention is to provide an improved means for receiving trash and compacting it, part of this means being a disposable container removable for holding the compacted trash either for pick-up by rubbish trucks or transportation by the householder himself to the municipal dump, incinerator, or recycling center.

Other objects and advantages will become apparent as the disclosure proceeds.

SUMMARY OF THE INVENTION

The outstanding and unexpected results obtained by the practice of the apparatus of this invention are obtained by a series of features and elements assembled and working together in interrelated combination.

A manual trash compactor that comprises a housing adapted to receive therein a bag having upstanding walls terminating in an open top for depositing the trash, and formed having a base with vertically extending panels extending upwardly from the base and terminating in an upper open end such that a rectangular configuration is formed to gain access to the housing.

Pressure applying means for compacting the trash within the bag is provided. The pressure applying means includes a plunger having a compacting head for engagement with the contents of the bag at one end thereof, and gripping means provided at the opposite end of the plunger and extending outwardly of the housing for moving the plunger axially to reciprocate the head in a compacting direction.

Weighting means associated with the pressure applying means to increase the weight thereof to facilitate the compacting of the trash within the bag is also provided. The weighting means associated with the pressure applying means to increase the weight thereof to facilitate the compacting of the trash within the bag may include an aperture axially extending in the plunger, with a cavity in the compacting head connected to the aperture at one end thereof to receive therein sand or other material for weight and a cap for closing off the aperture at the other end thereof.

Retaining means for releasably securing the open top of the bag within the housing during operation of the pressure applying means is utilized and comprises a plate operatively associated with each one of the panels to provide retention of the open top of the walls of the bag in fixed relationship to each one of the panels. Mounting means for pivotally securing each one of the plates with respect to one of the panels between an open position and a closed position is provided for permitting the bag to be removed from the housing in the open position and in the closed position compressing the upstanding walls of the bag against the panels. Latching means for releasably retaining each one of the plates in the closed position is provided such that the bag may be filled with trash.

Gripping means operatively associated with the lower section of each plate is provided and comprises a plurality of projections adapted to engage the wall of the bag in the closed position for retaining same in position. The gripping means further includes a plurality of recesses in each panel in conforming relationship with the projections, such that the projections may pierce the wall of the bag and be seated within the recesses so as to retain the bag in fixed position during operation of the pressure applying means.

Exit means associated with the housing to provide an opening for removal of the bag filled with compacted trash from within the housing is provided. The exit means includes one of the panels being hingeably mounted on one side of the housing adjacent to the bag so as to permit the removal of the bag with the compacted trash contained therein.

Locking means for releasably retaining the panel that is hingeably mounted in fixed relationship to the housing is also provided. The locking means comprises at least one locking pin extending outwardly from one of the plates in the closed position thereof, and at least one locking element mounted on the plate operatively associated with the panel that is hingeably mounted so as to engage the locking pin.

BRIEF DESCRIPTION OF THE DRAWINGS

The features and advantages of the present invention will become readily apparent to those skilled in the art from a reading of the detailed description hereinafter, when considered in conjunction with the accompanying drawings, wherein:

FIG. 3 is a fragmentary view taken along line 3—3 of FIG. 2;

FIG. 4 is a fragmentary view similar to FIG. 3, illustrating the open top of the bag in fixed relationship to the housing;

FIG. 5 is a fragmentary view illustrating the locking mechanism for retaining the pivotally mounted housing panel in its closed position;

FIG. 6 is a fragmentary view illustrating the gripping means for retaining the open top of the bag in fixed relationship to the housing during compaction of the trash therein;

FIG. 7 is a perspective view of a cowling to be used as the gripping means in accordance with another embodiment of the present invention; and FIG. 8 is a fragmentary view of the cowling ready to be positioned over the housing.

DETAILED DESCRIPTION OF THE DRAWINGS

Figure 1:
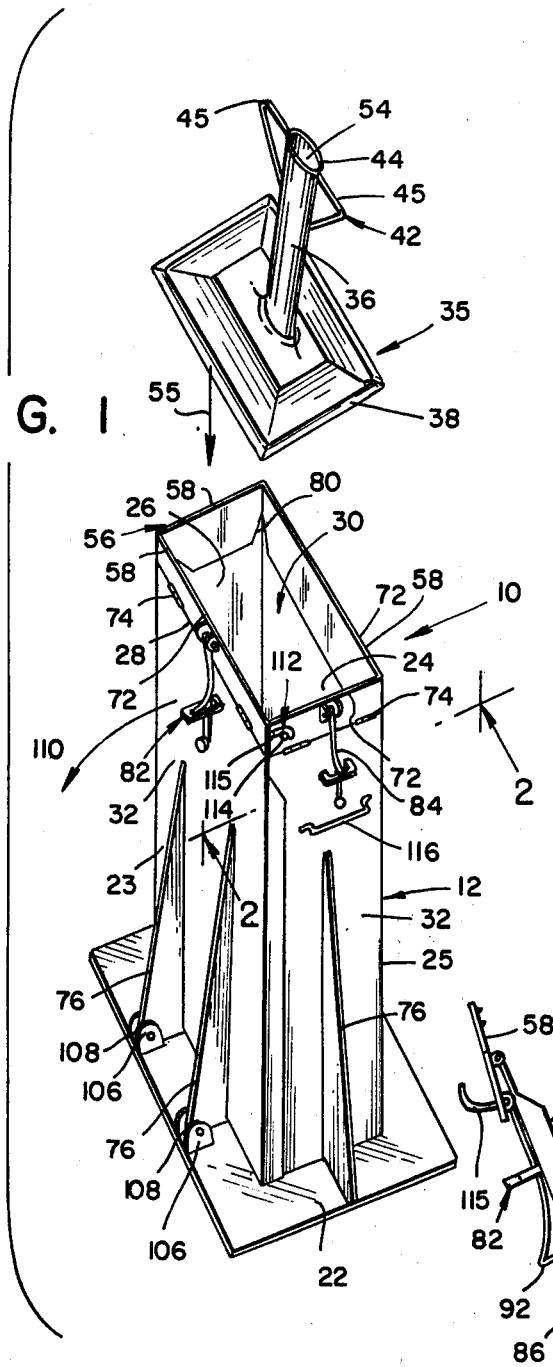
FIG. 1 is a perspective view, in exploded relationship, of the manual trash compactor of the present invention.

Referring to the drawings, FIGS. 1–6 illustrate a compactor 10 for the compression of trash and other waste products disposed therein. The compactor 10 is designed to be manually operated by the user and includes housing means 12 adapted to receive within the housing chamber 14 an exchangeable bag 15 that may be made of paper or plastic material.

The bag 15 may include, as illustrated in FIG. 3, a bottom wall 16 and upstanding walls 18 terminating in an open top 20. The bag 15 may be of the type generally received when purchasing goods in a supermarket, etc. In this way, the user of the compactor 10 may avoid the purchasing of additional bags 15.

The housing means 12 may have a rectangular configuration for receiving the bag 15 therein. It is appreciated that although the word rectangular is used herein, other equivalent shapes may be utilized if so desired. The housing 12 may be fabricated from plastic, metal or wood, and includes a base 22 with vertically and upwardly extending panels 23, 24, 25 and 26. Each of the panels terminates in an upper open end 28. The upper open ends 28 define the access means 30 to the housing 12, through which the trash is to be inserted. Each of the panels 23–26 further includes an outer surface 32 which may extend in substantially parallel spaced relationship to the inner surface 34 of each of the panels.

The chamber 14 within the housing 12 is defined by the respective inner surfaces 34 of the panels 23–26. The bag or receptacle 15 stands upright within the chamber 14 having its open top 20 releasably secured to one or more of the inner surfaces 34. While the bag 15 is in its supported position, the trash is deposited in the bag 15 from time to time and compacted, as hereinafter explained.

Figure 2:
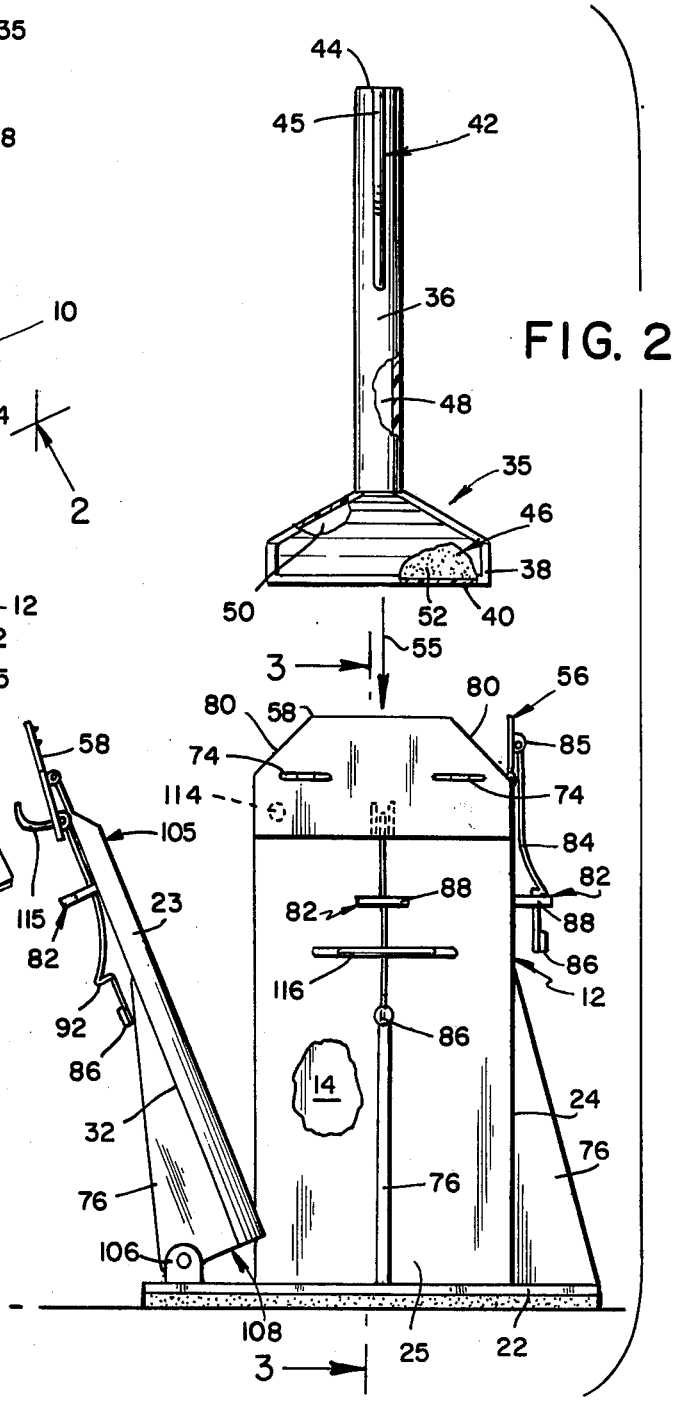
FIG. 2 is a side plan view, in exploded relationship, taken along line 2—2 of FIG. 1, showing the pivotally mounted housing panel in its open position of the manual trash compactor of the present invention.

To compact the trash, pressure applying means 35, illustrated in FIGS. 1 and 2, may be utilized, and may include an elongated plunger 36 having a compacting head 38 at one end thereof. The compacting head 38 has a frontal surface 40 for engagement with the contents of the bag. Gripping means 42 is provided at one end of the plunger 36. The total length of the pressure applying means 35 between the frontal surface 40 and rear surface 44 is to permit compaction within the full height of the housing means 12. The gripping means 42 may include a pair of spaced apart handles 45 adapted to be gripped by the user for moving the plunger 36 axially to reciprocate the head 38 in a compacting direction.

To save cost of shipment, and provide additional weight to the plunger head 38, there is provided weighting means 46 associated with the pressure applying means 35 to increase the weight thereof to facilitate the compacting of the trash within the bag 15. The weighting means 46 may include an aperture 48 extending axially in the plunger 36 with a cavity 50 contained in the compacting head 38. In this manner sand or other material may be poured into the upper end 44 of the pressure applying means 35 to fill the cavity 50.

The sand 52, may completely fill the cavity 50 and a cap 54, as illustrated in FIG. 1, may be provided at the upper end or rear surface 44 to seal off the aperture 48, which may also be filled with sand 52. Arrow 55 indicates the direction of the compaction force to be applied by the compacting head 38 as the user reciprocates the pressure applying means 35 which is adapted to extend through the upper open end 28 of the housing 12, as well as the bag 15. Obviously, the dimensions selected for the compacting head 38 are designed to fit freely within the open top 20 of bag 15.

In order to maintain the upstanding walls 18 of the bag 15 substantially against the inner surfaces 34 of the housing 12, there is provided retaining means 56 which releasably secures the open top 20 of the bag 15 within the housing 12 during operation of the pressure applying means 35. It must be appreciated that the retaining means 56 should be operational to quickly and easily secure the non-rigid walls 18 of the bag 15 in place and thereafter permit ready release thereof when the bag 15 has a supply of compacted trash therein.

To provide this relationship the retaining means 56 comprises the plate 58 operatively associated with each one of the panels 23–26. The plates 58 provide retention of the open top 20 of the walls 18 of the bag 15 in fixed relationship to each one of the panels 23–26. Each of the plates 58, as particularly illustrated in FIGS. 3 and 4, includes an upper section 60 and a lower section 62 that may be integrally formed with each other.

The upper section 60 includes an outer surface 63 and an inner surface 64. The lower section 62 similarly includes an outer surface 65 and an inner surface 66. Inner surfaces 64 and 66 may extend in substantially the same plane. To permit angular displacement of the plates 58, there is provided mounting means 68 for pivotally securing each of the plates 58 with respect to a given panel. The mounting means 68 is contained intermediate the lower end 70 and upper end 72 of each of the plates 58. As illustrated in FIGS. 1, 3 and 5, the mounting means 68 may include a pair of spaced apart hinges 74 connecting each of the panels 23–26 and a respective plate 58. As illustrated, a pair of hinges 74 are illustrated in conjunction with each of the plates 58.

The mounting means 68 permits each plate to be pivoted between an open position, as particularly illustrated in FIG. 3, and a closed position, as particularly illustrated in FIG. 4. In the open position the bag 15 may be inserted into or removed from the cavity 14 of the housing 12. In the closed position the outer surface 65 of each plate 58 compresses the wall 18 of the bag 15 against the inner surface 34 of the panels 23–26.

In the closed position of the panels 58 the outer surface 63 may coincide with the exterior or outer surface 32 of each of the panels 23–26 and form an extension thereof. To strengthen the housing 12, there may be provided support ribs 76 that extend vertically from the base 22 and upwardly along each of the panels 23–26. This provides additional strength when the outwardly directed forces are transmitted during the compaction of the trash within the bag.

Accordingly, the plates 58 in their closed position essentially form an extension of the panels 23–26 and are similarly dimensioned to permit the plunger head 38 to clear the inner surfaces 64 and 66 of each plate 58. To permit the plates to fold inwardly, as illustrated in FIGS. 1 and 4, each plate 58 may have a contoured corner 80 that may be on an angle on the lower section 62.

To maintain the plates 58 in their closed position, latching means 82 is provided in conjunction with each of the panels 23–26. The latching means is designed to permit ready release so that each plate may be folded to its open position for insertion or removal of bag 15. The latching means 82 includes a latch 84 operable with each of the plates 58. The latch 84 is pivotally coupled to each plate 58 along the outer surface 63 as by a retaining element 85, such that the latch 84 has a free end 86 for movement relative to a latch member 88 extending outwardly from each of the panels 23–26. The latch member 88 which extends outwardly from the outer surface 32 of each of the panels 23–26 includes an upper surface or ledge 90, which is adapted to frictionally engage an outwardly extending lip 92 of the latch 84.

The latch member 88, which extends below the open top 28 of each panel 23–26, has a recess 94 for confinement or containment of the latch 84 in the open position of the plate 58. In operation when it is desired to rotate the plate 58 from the open position in FIG. 3 to the closed position in FIG. 4, upward movement of latch 84 in the direction of arrow 95 will bring the latch into the position illustrated in FIG. 4.

By this movement, the plate 58 is pivoted around hinges 74 such that the inner surface 66 rotates to a substantially vertical position, as illustrated in FIG. 4, and the outer surface 65 is brought into abutting engagement with wall 18 of bag 15. At this point the lip 92 frictionally engages the ledge 90 and is retained in such position until subsequently released by applying an inwardly directed force in the direction of arrow 96, illustrated in FIGS. 4 and 5. This inward movement is possible due to the resilient nature of latch 84 in that it may be sufficiently deflected so as to permit a lowering through recess 94 and into the position illustrated in FIG. 3.

It is appreciated that each plate 58 is independently adjustable, and although the retaining means 56 is illustrated as operational with each of the panels, it is appreciated that depending upon the particular bag utilized the retaining means 56 may only need to be on a pair of opposing walls 18 of the bag 15.

It may also be found desirable to provide friction means 98 operatively associated with the bottom or base 22 of the housing 12 so as to prevent slipping of the compactor 10 along the floor during compaction. Although the friction means is illustrated as a pad 99 made from a friction resistant type material, suction cups or the like may be utilized if so desired.

Depending upon the thickness of the walls 18 of the bag 15, it may be desirable to provide gripping means 100 operatively associated with one or more of the plates 58. As particularly illustrated in FIGS. 3 and 6, the gripping means may be associated with the lower section 62 of plate 58 and include a plurality of spaced apart pointed projections 102 adapted to engage and pierce the wall 18 of the bag 15 in the closed position of each plate 58.

This provides additional retention to avoid slippage of the wall 18 relative to the respective panel 23–26. The gripping means 100 may further include a plurality of recesses 104 contained in each of the inner surfaces 34 of the respective panel 23–26. The spacing between each recess 104 is in conforming relationship with the projections 102, such that the projections 102 may pierce the wall 18 of bag 15 and be seated within the respective recesses 104. This provides a fixed firm securing relationship between the disposable bag 15 and the housing 12 during the compaction cycle.

In operation, when the bag 15 has fully compacted trash therein, it may be removed by one of two ways. One way is by moving each of the plates to the open position and vertically removing bag 15 from cavity 14 through the open end 28 of the housing 12. The other way is by providing exit means 105, as particularly illustrated in FIG. 2. The exit means 105 permits the pivotal movement of one of the panels 23–26 to be moved outwardly a sufficient distance to facilitate removal of the bag 15.

The exit means 105 may include panel 23 being mounted so as to be hingeably secured by hinges 106 that may be associated with the ribs 76 at the lower end thereof so as to be pivotally moved to the inclined position. Stop means 108 may be associated with panel 23 by properly positioning the hinge members 106 such that the outer or distal end 108 of each rib 76 abuts against base 22 of the housing 12 so as to limit the outward movement of panel 23. In this position the bag 15 of compacted trash may be removed from within the housing 12.

At the same time that the panel 23 is in its open position, the next disposable bag 15 may now be positioned within chamber 14. Once this is accomplished, the individual plates 58 by means of the latching means 82 are progressively brought into their closed position. Thereafter panel 23 is moved back to the position illustrated in FIG. 1 and the latching means 82 operatively associated with panel 23 is then closed. At this point in time bag 15 is fully retained in position to be used with the compactor 10. When the bag is once again full, the respective latches 84 are once again opened, and panel 23 may move outward in the direction of arrow 110.

To retain panel 23 in fixed relationship to the housing 12, locking means 112 is utilized and may operate simultaneously in conjunction with the latching means 82 associated with panel 23. The locking means 112 may include a locking pin 114 extending outwardly from the plates 58 adjacent to the plate 58 associated with panel 23. In the closed position of the plate 58 associated with panel 23, a locking element 115 is brought into engagement with the locking pin 114.

As particularly illustrated in FIG. 5, the locking pin 114 extends outwardly from the outer surface 63 of adjoining plate 58 of the upper section 60 in the closed position thereof. The locking element 115 grips the locking pin 114 in this position when plate 58 associated with panel 23 is in its closed position. Therefore, when panel 23 is brought into position and plate 58 is closed, the locking means 112 automatically occurs. If desired, the locking arrangement may be mounted independently of the plates 58.

A handle 116 may be provided on opposing panels 25 and. 26 to aid in transporting the housing 10.

Referring to FIGS. 7 and 8, there is illustrated another embodiment of the compactor 10*a* in which there is provided retaining means 56*a* that may be in the form of a cowling 123*a* having an opening therethrough. Gripping means 100*a* is utilized and may be formed from a non-skid strip or surface 120*a*, that may be in the form of a band of rubber or plastic two or three inches wide and extending below the upper open end 28*a* of the panels. The bag 15*a* has its upstanding walls 18*a* positioned adjacent to the non-skid surface 120*a*.

The cowling 123*a* which forms the retaining means 56*a* is used in conjunction with the non-skid surface 120*a* and is so dimensioned to retain the bag 15*a* in position as the pressure applying means is employed to compact the trash as described with respect to FIGS. 1–6. The cowling 123*a* includes an inner rim or plate 125*a* and an outer rim or plate 126*a* coupled at one end 128*a*. The inner rim 125*a* terminates in a free end 130*a*, and the outer rim 126*a* terminates in a free end 132*a*. The free ends 130*a* and 132*a* may be at the same or at different elevational levels.

The cowling 123*a* may be made of plastic or other material. The inner rims 125*a* may form a rectangular configuration in matching conformity to the open ends 28*a* of the access means 30*a* of the housing 12*a*. In addition at least two oppositely disposed rims are operatively associated with at least two of the panels to provide retention of the open top 20*a* of the bag 15*a*.

The inside rim 125*a* has its free end 130*a* dimensioned small enough to just fit inside the open top 20*a* of wall 18*a* of bag 15*a*. The inside rim wall 134*a* of the cowling 56*a* is tapered so that as it is pressed downward it will press the bag 15*a* against the non-skid surface 120*a* and keep it from slipping down. The plastic wall surface 134*a* of the cowling 123*a* would be able to slide against the bag wall 18*a* without gripping it. At the same time it would be pressing the bag wall 18*a* against the non-skid band 120*a* and retaining it in place. Concurrently the outer rim 126*a* would fit around the outside surface 32*a* of the housing 12*a*, and the inside surface 135*a* of the outer rim 126*a* will engage the outside surfaces 32*a*.

In this manner the retaining means 56*a* is positioned in telescopic relationship with the walls of the housing 12*a* each time a new bag 15*a* is positioned in place. When the bag 15*a* is full the cowling 56*a* is lifted vertically so as to free the bag 15*a* for removal from the housing 12*a*. The housing 12*a* may still be constructed in that one panel is pivotally mounted to act as exit means in a manner as previously illustrated.

Although illustrative embodiments of the invention have been described in detail herein with reference to the accompanying drawings, it is to be understood that the invention is not limited to the precise embodiments and that various changes and modifications may be effected therein without departing from the scope or spirit of the invention.

I claim:

1. A manual trash compactor comprising:

A. a housing adapted to receive therein a bag having upstanding walls terminating in an open top for containing the trash, B. said housing comprises a base with panels extending vertically and upwardly from said base and terminating in an upper open end, such that a rectangular configuration is formed to gain access to said housing, C. pressure applying means for compacting the trash within the bag, D. weighting means associated with said pressure applying means to increase the weight thereof to facilitate the compacting of the trash within the bag, E. retaining means for releasably securing the open top of the bag within said housing during operation of said pressure applying means, F. said retaining means comprises a plate operatively associated with at least two of said panels to provide retention of the open top of the walls of the bag in fixed relationship to said panels, G. mounting means for pivotally securing each one of said plates with respect to one of said panels between an open position and a closed position, said open position permitting the bag to be removed from said housing and said closed position compressing the upstanding walls of the bag against said panels, H. latching means for releasably retaining each one of said plates in said closed position, I. said plates each include an upper section and a lower section, and said lower section in the closed position of said plate extending in overlapping relationship to a corresponding one of said panels with the portion of the wall of the bag extending therebetween, so as to have the bag supported at its open top such that trash may be received therein, J. said upper section extends above said upper open end of said housing in said closed position, with said latching means including a latch operable with each one of said plates, and said latch is coupled to said panel and said plate and operable to maintain said plate in said closed position, and K. each said plate is hingeably mounted on one of said panels intermediate said upper section and said lower section.

2. A manual trash compactor as defined in claim 1, including friction means operatively associated with the bottom of said housing so as to prevent slipping of the compactor along the floor.

3. A manual trash compactor as defined in claim 1, wherein each said plate has contoured corners on said lower section thereof.

4. A manual trash compactor as defined in claim 1, wherein said pressure applying means includes:

a. a plunger having a compacting head for engagement with the contents of the bag at one end thereof, and b. gripping means provided at the opposite end of said plunger and extending outwardly of said housing for moving said plunger axially to reciprocate said head in a compacting direction.

5. A manual trash compactor as defined in claim 1, wherein said weighting means includes:

a. an aperture axially extending in said plunger, b. a cavity in said compacting head connected to said aperture at one end thereof to receive therein sand or other material for weight, and c. a cap for closing off said aperture at the other end thereof.

6. A manual trash compactor as defined in claim 1, including exit means associated with said housing to provide an opening for removal of the bag filled with compacted trash from within said housing.

7. A manual trash compactor as defined in claim 6, wherein said exit means includes one of said panels being hingeably mounted on one side of said housing adjacent to the bag so as to permit the removal of the bag with the compacted trash contained therein.

8. A manual trash compactor comprising:

A. a housing adapted to receive therein a bag having upstanding walls terminating in an open top for containing the trash, B. said housing comprises a base with panels extending vertically and upwardly from said base and terminating in an upper open end, such that a rectangular configuration is formed to gain access to said housing, C. pressure applying means for compacting the trash within the bag, D. weighting means associated with said pressure applying means to increase the weight thereof to facilitate the compacting of the trash within the bag, E. retaining means for releasably securing the open top of the bag within said housing during operation of said pressure applying means, F. said retaining means comprises a plate operatively associated with at least two of said panels to provide retention of the open top of the walls of the bag in fixed relationship to said panels, G. mounting means for pivotally securing each one of said plates with respect to one of said panels between an open position and a closed position, said open position permitting the bag to be removed from said housing and said closed position compressing the upstanding walls of the bag against said panels, H. latching means for releasably retaining each one of said plates in said closed position, I. said plates each include an upper section and a lower section, and said lower section in the closed position of said plate extending in overlapping relationship to a corresponding one of said panels with the portion of the wall of the bag extending therebetween, so as to have the bag supported at its open top such that trash may be received therein, J. said upper section extends above said upper open end of said housing in said closed position, with said latching means including a latch operable with each one of said plates, and said latch is coupled to said panel and said plate and operable to maintain said plate in said closed position, K. said latch includes a latch member extending outwardly from each said panel so as to couple said latch to said panel, and L. said latch includes an outwardly extending lip to frictionally engage said latch member so as to retain said plate in said closed position.

9. A manual trash compactor comprising:

A. a housing adapted to receive therein a bag having upstanding walls terminating in an open top for containing the trash, B. said housing comprises a base with panels extending vertically and upwardly from said base and terminating in an upper open end, such that a rectangular configuration is formed to gain access to said housing, C. pressure applying means for compacting the trash within the bag, D. weighting means associated with said pressure applying means to increase the weight thereof to facilitate the compacting of the trash within the bag.

E. retaining means for releasably securing the open top of the bag within said housing during operation of said pressure applying means, F. said retaining means comprises a plate operatively associated with at least two of said panels to provide retention of the open top of the walls of the bag in fixed relationship to said panels, G. mounting means for pivotally securing each one of said plates with respect to one of said panels between an open position and a closed position, said open position permitting the bag to be removed from said housing and said closed position compressing the upstanding walls of the bag against said panels, H. latching means for releasably retaining each one of said plates in said closed position, I. said plates each include an upper section and a lower section, and said lower section in the closed position of said plate extending in overlapping relationship to a corresponding one of said panels with the portion of the wall of the bag extending therebetween, so as to have the bag supported at its open top such that trash may be received therein, J. said upper section extends above said upper open end of said housing in said closed position, with said latching means including a latch operable with each one of said plates, and said latch is coupled to said panel and said plate and operable to maintain said plate in said closed position, and K. gripping means operatively associated with said lower section of each said plate, said gripping means comprising a plurality of projections adapted to engage the wall of the bag in said closed position for retaining same in position.

10. A manual trash compactor as defined in claim 9, wherein said gripping means further includes a plurality of recesses in each said panel in conforming relationship with said projections, such that said projections may pierce the wall of the bag and be seated within said recesses.

11. A manual trash compactor comprising:

A. a housing adapted to receive therein a bag having upstanding walls terminating in an open top for containing the trash, B. said housing comprises a base with panels extending vertically and upwardly from said base and terminating in an upper open end, such that a rectangular configuration is formed to gain access to said housing, C. pressure applying means for compacting the trash within the bag, D. weighting means associated with said pressure applying means to increase the weight thereof to facilitate the compacting of the trash within the bag, E. retaining means for releasably securing the open top of the bag within said housing during operation of said pressure applying means, F. said retaining means comprises a plate operatively associated with at least two of said panels to provide retention of the open top of the walls of the bag in fixed relationship to said panels, G. mounting means for pivotally securing each one of said plates with respect to one of said panels between an open position and a closed position, said open position permitting the bag to be removed from said housing and said closed position compressing the upstanding walls of the bag against said panels, H. latching means for releasably retaining each one of said plates in said closed position, I. exit means associated with said housing to provide an opening for removal of the bag filled with compacted trash from within said housing, J. said exit means includes one of said panels being hingeably mounted on one side of said housing adjacent to the bag so as to permit the removal of the bag with the compacted trash contained therein, and K. locking means for releasably retaining said panel that is hingeably mounted in fixed relationship to said housing, said locking means comprises;

a. at least one locking pin extending outwardly from one of said plates in the closed position thereof, and b. at least one locking element mounted on said plate operatively associated with said panel that is hingeably mounted so as to engage said locking pin.

12. A manual trash compactor comprising:

A. a housing adapted to receive therein a bag having upstanding walls terminating in an open top for containing the trash, B. said housing comprises a base with vertically extending panels extending upwardly from said base and terminating in an upper open end, such that a rectangular configuration is formed to gain access to said housing, C. pressure applying means adapted to extend through said upper open end of said housing for compacting the trash within the bag, D. said pressure applying means including:

(1) a plunger having a compacting head for engagement with the contents of the bag at one end thereof, and (2) gripping means provided at the opposite end of said plunger and extending outwardly of said housing for moving said plunger axially to reciprocate said head in a compacting direction, E. weighting means associated with said pressure applying means to increase the weight thereof to facilitate the compacting of the trash within the bag, F. said weighting means includes:

(1) an aperture axially extending in said plunger, (2) a cavity in said compacting head connected to said aperture at one end thereof to receive therein sand or other material for weight, and (3) a cap for closing off said aperture at the other end thereof, G. retaining means for releasably securing the open top of the bag within said housing during operation of said pressure applying means, H. said retaining means comprises a plate operatively associated with at least two of said panels to provide retention of the open top of the walls of the bag in fixed relationship to said panels, I. mounting means for pivotally securing each one of said plates with respect to one of said panels between an open position and a closed position, said open position permitting the bag to be removed from said housing and said closed position compressing the walls of the bag between said plates and said panels, J. latching means for releasably retaining each one of said plates in said closed position, K. exit means associated with said housing to provide an opening for removal of the bag filled with compacted trash from within said housing, L. said exit means includes one of said panels being hingeably mounted on one side of said housing adjacent to the bag so as to permit the removal of the bag with the compacted trash contained therein, M. locking means for releasably retaining said panel that is hingeably mounted in fixed relationship to said housing, N. said locking means comprises:

(1) at least one locking pin extending outwardly from one of said plates in the closed position thereof, and (2) at least one locking element mounted on said plate operatively associated with said panel that is hingeably mounted so as to engage said locking pin.

13. A manual trash compactor as defined in claim 12, including friction means operatively associated with the bottom of said housing so as to prevent slipping of the compactor along the floor.

14. A manual trash compactor as defined in claim 12, wherein:

a. said base has said panels extending substantially vertically upwardly therefrom terminating in said upper open end so as to provide access means through which trash may be deposited within the bag removably mounted in said housing, b. said compacting head adapted to be received through the spacing defined by said plates in the closed position thereof, and c. support ribs associated with each of said panels so as to strengthen same for outwardly directed forces transmitted during the compaction of the trash within the bag.

15. A manual trash compactor comprising:

A. a housing adapted to receive therein a bag having upstanding walls terminating in an open top for containing the trash, B. said housing comprises a base with vertically extending panels extending upwardly from said base and terminating in an upper open end, such that a rectangular configuration is formed to gain access to said housing, C. pressure applying means adapted to extend through said upper open end of said housing for compacting the trash within the bag, D. said pressure applying means including:

(1) a plunger having a compacting head for engagement with the contents of the bag at one end thereof, and (2) gripping means provided at the opposite end of said plunger and extending outwardly of said housing for moving said plunger axially to reciprocate said head in a compacting direction, E. weighting means associated with said pressure applying means to increase the weight thereof to facilitate the compacting of the trash within the bag, F. said weighting means includes:

(1) an aperture axially extending in said plunger, (2) a cavity in said compacting head connected to said aperture at one end thereof to receive therein sand or other material for weight, and (3) a cap for closing off said aperture at the other end thereof, G. retaining means for releasably securing the open top of the bag within said housing during operation of said pressure applying means, H. said retaining means comprises a plate operatively associated with at least two of said panels to provide retention of the open top of the walls of the bag in fixed relationship to said panels, I. mounting means for pivotally securing each one of said plates with respect to one of said panels between an open position and a closed position, said open position permitting the bag to be removed from said housing and said closed position compressing the walls of the bag between said plates and said panels, J. latching means for releasably retaining each one of said plates in said closed position, K. exit means associated with said housing to provide an opening for removal of the bag filled with compacted trash from within said housing, L. said exit means includes one of said panels being hingeably mounted on one side of said housing adjacent to the bag so as to permit the removal of the bag with the compacted trash contained therein, M. locking means for releasably retaining said panel that is hingeably mounted in fixed relationship to said housing, N. said plates each include an upper section and a lower section, O. said upper section extending above said upper open end of said housing in said closed position, and P. said lower section in the closed position of said plate extending in overlapping relationship to a corresponding one of said panels with the portion of the wall of the bag extending therebetween, so as to have the bag supported at its open top such that trash may be received therein.

16. A manual trash compactor as defined in claim 15, wherein each one of said plates is hingeably independently mounted on one of said panels intermediate said upper section and said lower section for movement between said open and closed positions.

17. A manual trash compactor as defined in claim 15, wherein:

a. said latch includes a latch member extending outwardly from each said panel so as to releasably couple said latch to said panel in the closed position of said plate, and b. said latch includes an outwardly extending lip to frictionally engage said latch member so as to retain said plate in said closed position.

18. A manual trash compactor as defined in claim 17, wherein said latch member extends below said open top of each said panel and having a recess for confinement of said latch in said open position of said plate.

19. A manual trash compactor comprising:

A. a housing adapted to receive therein a bag having uptanding walls terminating in an open top for containing the trash, B. said housing comprises a base with vertically extending panels extending upwardly from said base and terminating in an upper open end, such that a rectangular configuration is formed to gain access to said housing, C. pressure applying means adapted to extend through said upper open end of said housing for compacting the trash within the bag, D. said pressure applying means including:

(1) a plunger having a compacting head for engagement with the contents of the bag at one end thereof, and (2) gripping means provided at the opposite end of said plunger and extending outwardly of said housing for moving said plunger axially to reciprocate said head in a compacting direction, E. weighting means associated with said pressure applying means to increase the weight thereof to facilitate the compacting of the trash within the bag, F. said weighting means includes:

(1) an aperture axially extending in said plunger, (2) a cavity in said compacting head connected to said aperture at one end thereof to receive therein sand or other material for weight, and (3) a cap for closing off said aperture at the other end thereof, G. retaining means for releasably securing the open top of the bag within said housing during operation of said pressure applying means, H. said retaining means comprises a plate operatively associated with at least two of said panels to provide retention of the open top of the walls of the bag in fixed relationship to said panels, I. mounting means for pivotally securing each one of said plates with respect to one of said panels between an open position and a closed position, said open position permitting the bag to be removed from said housing and said closed position compressing the walls of the bag between said plates and said panels, J. latching means for releasably retaining each one of said plates in said closed position, K. exit means associated with said housing to provide an opening for removal of the bag filled with compacted trash from within said housing, L. said exit means includes one of said panels being hingeably mounted on one side of said housing adjacent to the bag so as to permit the removal of the bag with the compacted trash contained therein, M. locking means for releasably retaining said panel that is hingeably mounted in fixed relationship to said housing, and N. gripping means operatively associated with said lower section of each said plate, said gripping means comprising a plurality of projections adapted to engage the wall of the bag in said closed position for retaining same in position.

20. A manual trash compactor as defined in claim 19, wherein said gripping means further includes a plurality of recesses in each said panel in conforming relationship with said projections, such that said projections may pierce the wall of the bag and be seated within said recesses.

21. A manual trash compactor comprising:

A. a housing adapted to receive therein a bag having upstanding walls terminating in an open top for containing the trash, B. said housing comprises a base with vertically extending panels extending upwardly from said base and terminating in an upper open end, such that a rectangular configuration is formed to gain access to said housing, C. pressure applying means adapted to extend through said upper open end of said housing for compacting the trash within the bag, D. said pressure applying means including:

(1) a plunger having a compacting head for engagement with the contents of the bag at one end thereof, and (2) gripping means provided at the opposite end of said plunger and extending outwardly of said housing for moving said plunger axially to reciprocate said head in a compacting direction, E. weighting means associated with said pressure applying means to increase the weight thereof to facilitate the compacting of the trash within the bag, F. said weighting means includes:

(1) an aperture axially extending in said plunger, (2) a cavity in said compacting head connected to said aperture at one end thereof to receive therein sand or other material for weight, and (3) a cap for closing off said aperture at the other end thereof, G. retaining means for releasably securing the open top of the bag within said housing during operation of said pressure applying means, H. said retaining means comprises a plate operatively associated with at least two of said panels to provide retention of the open top of the walls of the bag in fixed relationship to said panels, I. mounting means for pivotally securing each one of said plates with respect to one of said panels between an open position and a closed position, said open position permitting the bag to be removed from said housing and said closed position compressing the walls of the bag between said plates and said panels.

J. latching means for releasably retaining each one of said plates in said closed position, K. exit means associated with said housing to provide an opening for removal of the bag filled with compacted trash from within said housing, L. said exit means includes one of said panels being hingeably mounted on one side of said housing adjacent to the bag so as to permit the removal of the bag with the compacted trash contained therein, M. locking means for releasably retaining said panel that is hingeably mounted in fixed relationship to said housing, N. said base has said panels extending substantially vertically upwardly therefrom terminating in said upper open end so as to provide access means through which trash may be deposited within the bag removably mounted in said housing, O. said compacting head adapted to be received through the spacing defined by said plates in the closed position thereof, P. support ribs associated with each of said panels so as to strengthen same for outwardly directed forces transmitted during the compaction of the trash within the bag, Q. said plates in the closed position thereof substantially coincide with the exterior surface of each of said panels and form an extension thereof, and R. stop means operatively associated with said panel being hingeably mounted so as to limit the outward movement thereof as the bag with compacted trash is removed from said housing.

22. A manual trash compactor comprising:

A. a housing adapted to receive therein a bag having upstanding walls terminating in an open top for containing the trash, B. said housing comprises a base with panels extending vertically and upwardly from said base and terminating in an upper open end, such that a rectangular configuration is formed to gain access to said housing, C. pressure applying means for compacting the trash within the bag, D. weighting means associated with said pressure applying means to increase the weight thereof to facilitate the compacting of the trash within the bag, E. retaining means for releasably securing the open top of the bag within said housing during operation of said pressure applying means, F. said retaining means comprises a cowling having an opening therethrough and operatively associated with at least two of said panels to provide retention of the open top of the walls of the bag in fixed relationship to said panels, G. said cowling including:

(i) an inner rim having an inner surface and terminating in a free end, (ii) an outer rim having an inner surface and terminating in a free end, said rims joined to each other at the end opposite said free ends, and (iii) said inner surfaces angularly disposed relative to each other so as to have said open top of said panels and said walls of said bag extend therebetween in wedging relationship, such that said pressure applying means may be utilized when said cowling is in assembled relationship with said housing and said cowling removed when said bag is to be removed or replaced, and H. gripping means operatively associated with said panels adjacent said open end thereof, said gripping means comprising a strip of non-skid material on said panels adapted to engage the wall of the bag when said cowling is mounted on said housing.

23. A manual trash compactor as defined in claim 22, wherein said free end of said inner rim extends below the free end of said outer rim, such that said angularly disposed inner surface of said inner rim initially engages said walls of said bag as said cowling is positioned in telescopic relationship with said housing, and said walls of said bag are forced into abutting engagement with said gripping means.

24. A manual trash compactor as defined in claim 22, wherein said pressure applying means includes:

a. a plunger having a compacting head for engagement with the contents of the bag at one end thereof, and b. gripping means provided at the opposite end of said plunger and extending outwardly of said housing for moving said plunger axially to reciprocate said head in a compacting direction.

25. A manual trash compactor as defined in claim 24, wherein said weighting means includes:

a. an aperture axially extending in said plunger, b. a cavity in said compacting head connected to said aperture at one end thereof to receive therein sand or other material for weight, and c. a cap for closing off said aperture at the other end thereof.

26. A manual trash compactor as defined in claim 22, including exit means associated with said housing to provide an opening for removal of the bag filled with compacted trash from within said housing when said cowling is removed from assembled relationship with said housing.

27. A manual trash compactor as defined in claim 26, wherein said exit means includes one of said panels being hingeably mounted on one side of said housing adjacent to the bag so as to permit the removal of the bag with the compacted trash contained therein.

* * * * *